United States Patent [19]

Witt

[11] 4,017,283

[45] Apr. 12, 1977

[54] METHOD AND PLANT FOR MAKING UP NITROGEN VAPORIZATION LOSSES IN NITROGEN-CONTAINING LIQUIFIED NATURAL GAS CARRYING TANKERS

[75] Inventor: Karel Witt, Volketswil, Switzerland

[73] Assignee: Sulzer Brothers Limited, Winterthur, Switzerland

[22] Filed: Oct. 17, 1974

[21] Appl. No.: 515,539

Related U.S. Application Data

[63] Continuation of Ser. No. 304,900, Nov. 9, 1972, abandoned.

[30] Foreign Application Priority Data

Nov. 17, 1971 Switzerland ..... 16685/71

[52] U.S. Cl. ..... 62/40; 62/42; 62/54; 62/28; 62/402

[51] Int. Cl.[2] ..... F25J 1/02

[58] Field of Search ..... 62/9, 11, 40, 27–29, 62/54, 55, 23, 24, 26, 30, 31, 32, 34, 38, 39, 42; 220/85 VR, 85 VS; 69/402

[56] References Cited

UNITED STATES PATENTS

| | | | |
|---|---|---|---|
| 2,500,118 | 3/1950 | Cooper | 62/40 |
| 2,959,928 | 11/1960 | Maker | 62/54 |
| 3,098,362 | 7/1963 | Sohda et al. | 62/54 |
| 3,108,446 | 10/1963 | Sohda et al. | 62/54 |
| 3,797,261 | 3/1974 | Juncker et al. | 62/40 |
| 3,818,714 | 6/1974 | Etzbach et al. | 62/40 |

*Primary Examiner*—Frank W. Lutter
*Assistant Examiner*—Frank Sever
*Attorney, Agent, or Firm*—Kenyon & Kenyon Reilly Carr & Chapin

[57] ABSTRACT

The vaporized nitrogen-containing natural gas is drawn off from a ship's hold and at least a part is sent through a rectifying column of a separating means to separate out the nitrogen in vapor form. The separated nitrogen is then liquified and stored for subsequent feeding into any one of a number of nitrogen-using means such as a refrigerating means used to cool the liquified natural gas in the hold. The liquified natural gas is returned to the hold from the rectifying column.

5 Claims, 1 Drawing Figure

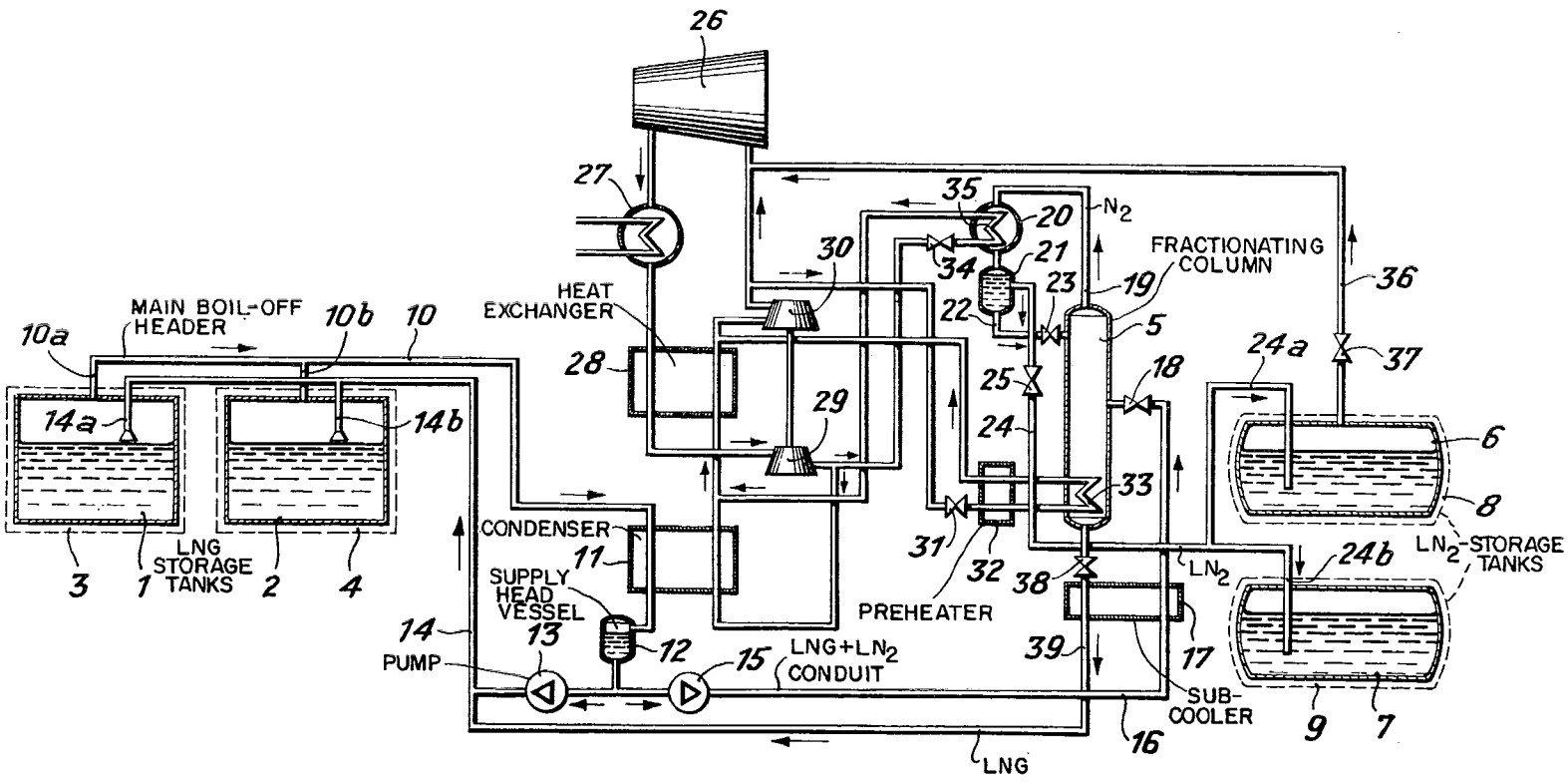
LN2-STORAGE TANKS
FRACTIONATING COLUMN
N2
LN2
SUB-COOLER
PREHEATER
LNG
LNG+LN2 CONDUIT
HEAT EXCHANGER
CONDENSER
SUPPLY HEAD VESSEL
PUMP
MAIN BOIL-OFF HEADER
LNG STORAGE TANKS

METHOD AND PLANT FOR MAKING UP NITROGEN VAPORIZATION LOSSES IN NITROGEN-CONTAINING LIQUIFIED NATURAL GAS CARRYING TANKERS

This is a continuation of application Ser. No. 304,900 filed November 9, 1972, now abandoned.

This invention relates to a method and plant for making up nitrogen vaporization losses in nitrogen-containing liquified natural gas carrying tanks.

It has been known to transport natural gas in liquified form within holds in tankers. It has also been known that natural gas will vaporize to some extent, for example, due to the influx of heat in the tanker holds during a journey. Thus, these tankers have usually been provided with refrigerating machines and systems in order to re-liquify the vaporized natural gas. Generally, the refrigerating systems have used nitrogen as a refrigerant. However, leakage losses of the nitrogen usually occur over prolonged periods of time in the refrigerating systems, for example, at the glands or seals of the compressors and fittings of such systems. Thus, in order to make up these leakage losses of nitrogen, refrigerant stocks have been carried on board so that fresh nitrogen can be supplied to the refrigerating systems from time to time.

It has also been known that these tankers have used fire extinguishing systems which rely on the use of inert gases such as nitrogen for operation. However, leakage losses have also been inevitable in these systems. In order to make up these losses, it would also be necessary to carry separate cylinders of stored inert gas or to produce the appropriate quantity of inert gas on board the tanker in relatively expensive inert gas generators.

It has also been known that natural gas can contain significant amounts of nitrogen.

Accordingly, it is an object of the invention to make up refrigerant gas losses on tankers carrying nitrogen-containing natural gas by using the nitrogen in the natural gas.

It is another object of the invention to use the nitrogen in a nitrogen-containing natural gas being transported in a tanker to make-up leakage losses in inert gas operating systems on board the tanker.

It is another object of the invention to provide an economical means of making up inert gas leakage losses in natural gas transporting tankers.

Briefly, the invention provides a method and plant for making up nitrogen vaporization losses in tankers carrying liquified nitrogen-containing natural gas in a hold. The method includes the steps of removing the nitrogen-containing natural gas from the hold, of thereafter separating the nitrogen from the natural gas, and of storing the separated nitrogen for subsequent use while returning the natural gas to the hold in liquified form.

The stored nitrogen is used to make up nitrogen losses in systems which operate with nitrogen as a working medium. For example, the nitrogen can be supplied to a refrigerating circuit of a refrigerating means used to cool the liquified natural gas in the hold of the tanker. In any event, the separated nitrogen is liquified for storing.

The plant of the invention includes a separating means communicating with the hold to receive the nitrogen-containing natural gas and to separate the nitrogen therein from the natural gas as well as refrigerating means communicating with the separating means to receive any liquefy the separated nitrogen and to receive and liquify the separated natural gas.

The separating means includes a rectifying column in which the nitrogen-containing natural gas is separated into a nitrogen top product and a natural gas bottom product. The nitrogen top product is then condensed in a condenser and fed through a discharge conduit to a storage tank for storage while a portion is fed through another discharge conduit to the rectifying column as a reflux. The natural gas bottoms product is fed to the hold.

In order to prepare the nitrogen-containing natural gas for rectification in the rectifying column, the refrigerating means includes a heat exchanger in which the natural gas is passed into heat exchange relation with a flow of cooler nitrogen gas prior to rectification so as to liquefy the nitrogen-containing natural gas.

These and other objects and advantages of the invention will become more apparent from the following detailed description when taken in conjunction with the accompanying drawing in which the Figure illustrates a schematic view of a plant according to the invention in a sea-going tanker.

Referring to the drawing, the tanker includes two holds 1, 2 which act as LNG-storage tanks and are thermally insulated from the surroundings by thermal insulation 3, 4. Since natural gas continually vaporizes due to the influx of heat to the tanker holds 1, 2 a refrigerating means is provided to re-liquefy and recycle the vaporized natural gas to the holds 1, 2. This refrigerating means uses nitrogen as a refrigerant or working medium. The refrigerating means includes a heat exchanger 11 i.e. a condenser which receives a flow of vaporized nitrogen-containing natural gas via a main boil-off header or conduit 10 connected by branch conduits **10*a*, 10*b*, to the holds 1, 2. The heat exchanger 11 also receives a counter-flow of cooler nitrogen for condensing and liquefying the natural gas. As shown, the conduit 10 connects with a feed or supply head vessel 12 below the heat exchanger 11 which cycles the liquefied natural gas back to the holds 1, 2 via a conduit 14 in which a feed pump 13 is located and branch conduits 14*a*, 14*b*. The holds 1, 2 conduits 10, 14 and condenser 11 thus constitute a closed loop which is in heat exchange relation via the condenser 11** with the closed refrigerating loop.

In order to make up leakage losses of the nitrogen occurring at leaky points in the refrigerating means, a separating means is provided to separate nitrogen from the vaporized natural gas, and to supply the nitrogen to the refrigerating means.

As shown, the separating means includes a rectifying i.e. fractionating column 5 for separating the nitrogen from the natural gas and two liquid nitrogen storage tanks, 6, 7 for storing the separated nitrogen in liquid form. Both tanks 6, 7 are each thermally insulated from the surroundings by thermal insulation 8, 9. In addition, the separating means includes a natural gas feed conduit 16 connected in parallel with the conduit 14 to the feed vessel 12 and to the rectifying column 5. A feed pump 15 is interconnected in the conduit 16 to pump liquefied natural gas therethrough to the rectifying column 5. Also, a heat exchanger i.e. a sub-cooler 17 is interposed in the path of the conduit 16 to effect further cooling and a control valve 18 is interposed in the conduit 16 near the rectifying column 5 to control the flow of gas to the rectifying column.

The rectifying column has a draw-off conduit 19 to draw off vaporized nitrogen for passage into a condenser 20. The condenser 20, in turn, connects to a feed vessel 21 wherein the condensed nitrogen is received. One discharge conduit 22 connects the feed vessel 21 via a control valve 23 to the rectifying column 5 to act as a means to deliver nitrogen as a reflux while another discharge conduit 24 connects the feed vessel 21 via a control valve 25 to branch conduits 24*a*, 24*b* to the storage tanks 6, 7.

The rectifying column 5 also has a draw-off conduit 39 in which a control valve 38 is placed to draw off liquefied natural gas from the rectifying column 5. This draw-off conduit 39 connects to the conduit 14 for re-cycling the natural gas back to the holds 1, 2 via the conduit 14.

The refrigerating means includes a compressor 26 for compressing nitrogen, a cooler 27 downstream of the compressor for dissipating compression heat from the compressed nitrogen, a countercurrent heat exchanger 28 for cooling the compressed nitrogen and an expansion turbine 29 in which the nitrogen is expanded and cooled further. The expansion turbine 29 communicates with a brake (i.e. booster) compressor 30 over a conduit 40. The brake compressor 30 is connected to the shaft of the expansion turbine 29. The conduit 40 passes through the heat exchangers 11, 28 to pass the cool nitrogen first into heat exchange relation with the vaporized natural gas in the conduit 10 and second into heat exchange relation with the warmer nitrogen to the compressor 26 to recycle the refrigerant nitrogen.

The expansion turbine 29 also connects to a heat exchange coil 35 in the condenser 20 via a control valve 34. The heat exchange coil 35 is connected to a point in the conduit 40 between the heat exchangers 11, 28.

The brake compressor 30 also connects to a heating coil 33 in the rectifying column 5 via a control valve 31 and a countercurrent heat exchanger i.e. a preheater 32. The heating coil 33 is connected to a point in the conduit 40 downstream of the heat exchanger 28 and upstream of the brake compressor 30.

In operation, some of the natural gas stored in the ship tanker holds 1, 2 vaporizes during the tanker journey, which usually is of long duration. The vaporized natural gas is then drawn off via the conduits 10*a* and 10*b* to the conduit 10, and liquefied by heat exchange with nitrogen in the heat exchanger 11 disposed in the refrigerating circuit of the refrigerating means. The liquefied natural gas flows off to the feed vessel 12, from which some of the liquefied gas is returned to the tanker holds 1, 2 by the pump 13 via the conduit 14 and connecting conduits 14*a*, 14*b*. The remainder of the liquefied natural gas is fed to the rectifying column 5 by means of the pump 15 via the conduit 16, heat exchanger 17 and control valve 18. Nitrogen is then separated from the natural gas in substantially pure form in the column 5 and is drawn off as a top product via the conduit 19, liquefied in the condenser 20 by heat exchange with the nitrogen originating from the refrigerating circuit, and fed to the feed vessel 21.

Some of the liquefied nitrogen in the feed vessel 21 is returned to the column 5 via the conduit 22 and control valve 23 while the remainder of the nitrogen flows via the conduits 24, control valve 25, and connecting conduits 24*a*, 24*b* to the storage tanks 6, 7.

Liquid natural gas from which the nitrogen has been removed is drawn off from the column 5 as the bottom product via the conduit 39 and control valve 38. After further cooling of the natural gas in the heat exchanger 17, the liquid natural gas flows back to the tanker holds 1, 2 via the conduit 39 and the connecting conduits 14, 14*a*, 14*b*.

In the refrigerating circuit, nitrogen is compressed in the compressor 26, the compression head is dissipated in the cooler 27, cooled in the countercurrent heat exchanger 28, expanded in the expansion turbine 29 and cooled further at the same time.

The expanded nitrogen is taken for the greater part through the heat exchanger i.e. condenser 11 and heated up by heat exchange with condensing natural gas, and is then taken through the heat exchanger 28 and heated further. Finally, the nitrogen is compressed in the brake compressor 30 and drawn in substantially at ambient temperature by the compressor 26.

When the nitrogen has emerged from the brake compressor 30, a small quantity of nitrogen is branched off and is fed via the control valve 31 to the countercurrent heater 32, where the nitrogen is cooled. The nitrogen then flows through a heating coil 33 disposed in the column 5 and is used for partial vaporization of the bottom product. The nitrogen is then heated in the heat exchanger 32 and returned to the intake conduit of the compressor 30.

In addition, a small quantity of nitrogen is drawn from the refrigerating circuit at the output side of the expansion turbine 29, this amount being determined by the control valve 34, and then flows through the heat exchange coil 35 disposed in the condenser 20. This nitrogen is then introduced into the refrigerating circuit return line upstream of the heat exchanger 28.

The nitrogen leakage losses occurring in the refrigerating means are made up from the tank 6 in this example. A conduit 36 leads from the tank 6 and contains a throttle valve 37 to expand the nitrogen to the intake pressure of the compressor 26, the other end of the conduit being connected to the intake side of the compressor 26.

In addition, the tank 6 can also make up the nitrogen requirements for maintaining an inert atmosphere in the reception holds (not shown in detail) surrounding the tanker holds 1, 2, and to maintain a dry atmosphere in the thermal insulations 3, 4. The associated connecting pipes and pressure reducing and control means are not shown in the drawing.

The tank 7 is used to make up the nitrogen losses in one or more fire extinguisher units (not shown). The connecting conduits to these units, and the units themselves, have been omitted from the drawing for the sake of clarity.

The invention is not limited to the exemplified embodiment illustrated. For example, natural gas could also be introduced into the rectifying column in vapor form, i.e., without prior liquefaction.

The invention also covers cases in which, for example, the separated nitrogen is utilized to make up only the refrigerating system losses or only the inert gas losses or consumption in fire extinguisher units, or in the reception holds or insulating holds of the tanker holds. Inert gas requirements of this kind may be due to the need to maintain an inert atmosphere at all times in the reception holds surrounding the tanker holds filled with the liquid natural gas. Insulating holds of tanker holds which do not have reception holds are also advantageously cooled in a dry nitrogen atmosphere in order to prevent the moisture from the air penetrating the thermal insulation.

Generally, the nitrogen separated from the natural gas may be utilized in any tanker equipment in which there is a nitrogen loss or consumption required to be made up.

What is claimed is:

1. In combination with the hold of a tanker, a plant for obtaining liquified nitrogen for use aboard said tanker from a liquified natural gas body being transported in said hold of said tanker; said plant comprising primarily a fractional distillation column; and a closed looped nitrogen refrigerant cycle;

said column further comprising a condenser coil, a reboiler coil, and an overhead liquid nitrogen receiver having at least one outlet for feeding liquified nitrogen not required for column reflux to at least one storage vessel, said cycle further comprising at least a primary compressor, a brake compressor and an expansion turbine, conduit means for feeding nitrogen refrigerant from the discharge of said primary compressor to the inlet of said turbine, conduit means for feeding at least a portion of said refrigerant from the discharge of said turbine through an expansion valve to the inlet of said condenser coil of said column, conduit means for feeding said portion from the outlet of said condenser coil to the inlet of said brake compressor, conduit means for feeding at least a first portion of the refrigerant from the outlet of said brake compressor through an expansion valve to the inlet of said reboiler coil of said column, conduit means to feed said first portion from the outlet of said reboiler coil to the inlet of said brake compressor, conduit means for feeding at least a second portion of the refrigerant from the discharge of said brake compressor to the inlet of said primary compressor conduit means for feeding nitrogen for refrigerant makeup from said storage vessel to said cycle, and mechanical linkage means for transmitting mechanical energy from said expansion turbine to said brake compressor.

2. In combination with a hold of a tanker carrying liquified nitrogen-containing natural gas; a plant for generating nitrogen, said plant comprising a closed loop refrigerating means separate from said hold and including a condenser and a heat exchanger coil and having a gaseous nitrogen working medium therein for reliquifying vaporized nitrogen-containing natural gas passing from said hold through said condenser;

a first conduit connected between an outlet of said condenser and said hold to return a first part of the reliquified nitrogen-containing natural gas to said hold;

a fractioning column for receiving the remaining part of the reliquified nitrogen-containing natural gas and for separating nitrogen from the reliquified natural gas of said remaining part;

a second conduit connected between the bottom of said fractionating column and said hold to return liquified nitrogen-free natural gas from said fractionating column to said hold;

said heat exchange coil contacting the overhead stream from said fractionating column for liquifying the nitrogen vapor in said fractionating column;

at least one storage tank connected to said fractionating column for receiving a part of said liquified nitrogen for subsequent use outside of said hold; and a third conduit connected between said liquified nitrogen storage tank and said closed loop refrigerating means for supplying nitrogen to said refrigerating means to make up refrigerant nitrogen losses therein.

3. The combination as set forth in claim 2 which further includes a heating coil in said fractionating column connected to said refrigerating means to receive a flow of cooled nitrogen therefrom, and a second condensor in said refrigerating means connected to said fractionating column to receive and condense a flow of nitrogen from said column.

4. A plant for making up nitrogen vaporization losses in tankers carrying liquified nitrogen-containing natural gas in a hold, comprising a closed loop refrigerating means separate from said hold and including a condenser and a heat exchange coil and containing gaseous nitrogen therein as a working medium for reliquifying vaporized nitrogen-containing natural gas passing from said hold through said condenser, a first conduit between an outlet of said condenser and said hold to return a part of the reliquified nitrogen-containing natural gas to said hold;

a fractionating column containing stripping and rectifying sections;

a second feed conduit connecting an outlet of said condenser to said column to feed at least a part of the reliquified nitrogen-containing natural gas to said fractionating column for separation of the nitrogen from the reliquified natural gas in said part;

a second condenser in said refrigerating means to receive vaporized nitrogen from said column, said heat exchange coil being disposed in said condenser;

a draw-off conduit connecting said column to said second condenser for delivering the nitrogen vapor drawn-off from said column thereto for liquifying therein;

at least one storage tank for receiving said reliquified nitrogen vapor;

a third conduit connected between said liquified nitrogen storage tank and said refrigerating means for supplying nitrogen to said refrigerating means to make up refrigerant nitrogen losses therein;

a fourth conduit connecting said column to said hold for returning liquid nitrogen-free natural gas to said hold;

a heating coil disposed in the lower portion of said column connected to said refrigerating means; and a pair of discharge conduits connected to said second condenser to discharge liquified nitrogen therefrom, one of said discharge conduits being connected to said column to deliver liquified nitrogen thereto as a reflux, the other of said discharge conduits being connected to said storage tank receiving the remaining liquified nitrogen.

5. A plant as set forth in claim 4 which further includes a heat exchanger connected to said refrigerating means and said heating coil to cool the nitrogen circulating in said refrigerating means prior to delivery to said heating coil.

* * * * *